US006142766A

United States Patent [19]

Hu

[11] Patent Number: 6,142,766

[45] Date of Patent: Nov. 7, 2000

[54] SAFETY LIGHTER

[75] Inventor: Yong Yuan Hu, South El Monte, Calif.

[73] Assignee: Zreative, Inc., S. El Monte, Calif.

[21] Appl. No.: 09/389,693

[22] Filed: Oct. 14, 1999

[51] Int. Cl.[7] ..... F23Q 2/28

[52] U.S. Cl. ..... 431/132; 431/153

[58] Field of Search ..... 431/153, 255, 431/129, 132, 134

[56] References Cited

U.S. PATENT DOCUMENTS

| | | | |
|---|---|---|---|
| 4,487,570 | 12/1984 | Lowenthal | 431/132 |
| 5,055,033 | 10/1991 | Lee | 431/255 |
| 5,356,286 | 10/1994 | Sher | 431/153 |
| 5,409,372 | 4/1995 | Nobuo | 431/153 |
| 5,456,598 | 10/1995 | McDonough et al. | 431/153 |
| 5,697,775 | 12/1997 | Saito et al. | 431/153 |

*Primary Examiner*—Ira S. Lazarus
*Assistant Examiner*—Sara Clarke
*Attorney, Agent, or Firm*—Raymond Y. Chan; David and Raymond

[57] ABSTRACT

A piezoelectric lighter incorporates with a safety device which includes a pusher cap slidably mounted on a pusher cavity of a casing in a vertically movable manner and attached to a top end of a piezoelectric unit; a locking member fitting on an upper portion of the casing, wherein the locking member having a stopper latch locking up the pusher cap for blocking the pusher cap in a vertical manner. The safety device further includes a resilient unit, which is articulated on an axle mounted on the upper portion of the casing, normally urging and retaining the locking member locking up the pusher cap so as to block any downwardly movement of the pusher cap and thus prevent the ignition operation of the piezoelectric unit. Thereby, in order to ignite the piezoelectric lighter, the locking member must be pressed transversely inward to move the latch of the locking member out of the edge of the cap body of the pusher cap. Once in this position, the pusher cap can be pressed downward to compress the piezoelectric unit to ignite the lighter.

7 Claims, 4 Drawing Sheets

SAFETY LIGHTER

BACKGROUND OF THE PRESENT INVENTION

1. Field of Invention

The present invention relates to piezoelectric lighters, and more particularly to a piezoelectric lighter having a safety device for normally locking the pusher cap thereof so as to prevent the lighter from being ignited either accidentally or by children.

2. Description of Related Arts

Most accidental fires are started by the ignorant usage of cigarette lighters. In order to prevent the lighter from ignition accidentally or by a child, the conventional lighter may employ a safety device which includes a lock member for deterring depression of the actuating lever. Since the lock member is manually movable between a locked position and a released position, the lock member tends to stay at the released position without a manual recovery from the released position to the initial locked position after the use of the lighter, whereby the safety device remains unlocked. Leaving the lock member at the released position permits the actuating lever to be depressed, rendering the safety device inoperable. Specifically then, to ensure safety, the existing safety devices always require a manual re-locking operation after every use of the lighter. Hence, there should be expected further improvements of the lock mechanism in terms of safety.

To solve the drawbacks set forth above, there have been proposed a safety mechanism having a lock member to impede the depression of the actuating lever. Such safety mechanism provides an auto return function, wherein the lock member automatically returns to the locked position in response to the ignition when it is operated after the lock member has been manually moved to the released position. However, the operation of this safety mechanism is unreliable because of a probability that the lock member will return to the locked position by its own reactive force, which is due to the resilience of the material constituting the lock member. This adverse result affects the ease of releasing the lock mechanism in a lighter, which is generally operated with a single finger, e.g. the thumb, and leads to different operational results depending on the users. Therefore, safety mechanism of this type can be considered disadvantageous in practical use.

As can be seen from the above description, conventional safety lighters have drawbacks in practical use, and hence there has been a demand for a childproof safety lighter which is improved in both safety and operability.

Further, in manufacturing such safety lighters, it is required to rationalize the assembling steps, to improve assembling accuracy, to enhance the handling of the safety device, and to reduce the manufacturing cost.

SUMMARY OF THE PRESENT INVENTION

The main object of the present invention is to provide a safety device for a piezoelectric lighter for preventing under age children from igniting the lighter without adult supervision.

Another object of the present invention is to provide a safety device for a piezoelectric lighter to normally lock up the pusher cap to prevent any unwanted lighting operation of the piezoelectric lighter.

Another object of the present invention is to provide a safety device for a piezoelectric lighter, which can automatically return to a locking condition after each ignition operation, so as to prevent any lighting operation of the piezoelectric unit by locking up the downward movement of the pusher cap, Another object of the present invention is to provide a safety device for a piezoelectric lighter, which does not require to alter the original structural design of the piezoelectric lighter, so as to minimize the manufacturing cost for incorporating the safety device with every conventional piezoelectric lighter having a pusher cap.

Another object of the present invention is to provide a safety device for a piezoelectric lighter, wherein the lighter is improved in both safety and operability. The safety device of the lighter cooperates with an ignition mechanism as in one single action and is advantageous in practical use.

In order to accomplish the above objects, the present invention provides a safety lighter which is a piezoelectric lighter constructed as a cigarette lighter or a barbecue lighter, comprising:

- a casing having a lower portion containing a liquefied gas storage case therein and an upper portion having a gas emitting nozzle appearing therein to communicate with the liquefied gas storage case for controlling a flow of gas;
- a piezoelectric unit casing attaching to the liquefied gas storage case and defining a pusher cavity therein;
- a windshield mounting on the upper portion of the casing and encircling the gas emitting nozzle; and
- a piezoelectric unit fitted in the piezoelectric unit casing for generating piezoelectricity, wherein the piezoelectric unit comprises a movable operating part upwardly extended from the pusher cavity and an ignition tip extended towards the gas emitting nozzle;
- a pusher cap slidably fitted to the pusher cavity of the casing in a vertically movable manner, the pusher cap being attached to a top end of the piezoelectric unit and comprising a cap body exposing above the piezoelectric unit casing and a cap leg extending downwardly from the cap body; and
- a safety device, which comprises:
  - a locking member, which is pivotally connected to the upper portion of the casing, having a stopper latch at a bottom end thereof for normally engaging with the cap body so as to block and stop any possible downward movement of the pusher cap; and
  - a resilient element provided between the locking member and the upper portion of the casing for urging the locking member towards the cap body for retaining the engagement of the stopper latch with the cap body for normally blocking any downwardly movement of the pusher cap, so as to lock up the pusher cap to prevent the ignition operation of the piezoelectric unit.

In other words, the piezoelectric lighter is normally locked from ignition unless an adult user's thumb inwardly pushes the locking member until the stopper latch disengaging with the cap body and presses down the pusher cap at the same time. After every ignition, the resilient element will automatically reset the locking member outwardly to lock up the pusher cap once the user's inwardly pushing force applied against the locking member is released.

DETAILED DESCRIPTION OF THE PREFERRED EMBODIMENTS

Figure 2:
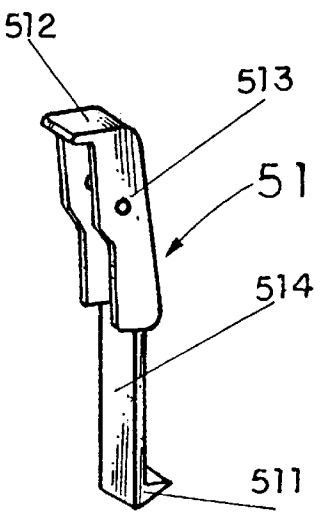
FIG. 2 is a perspective view of a locking member of the safety lighter according to the above first preferred embodiment of the present invention.

Referring to FIGS. 1 to 4, a safety lighter according to a first preferred embodiment of the present invention is illustrated, wherein the safety lighter comprises a piezoelectric lighter 10 and a safety device 50.

The piezoelectric lighter 10 comprises a casing 11 having a lower portion 111 containing a liquefied gas storage case 12 therein and an upper portion 112 having a gas emitting nozzle 13 appearing therein to communicate with the liquefied gas storage case 12 for controlling the flow of gas.

The piezoelectric lighter 10 further comprises a piezoelectric unit casing 14 attaching to the liquefied gas storage case 12 and defining a pusher cavity 141 therein, a windshield 15 mounting on the upper portion 112 of the casing 11 and encircling the gas emitting nozzle 13, and a piezoelectric unit 20 which is fitted in the piezoelectric unit casing 14 for generating piezoelectricity.

The piezoelectric unit 20 comprises a movable operating part 21 which is upwardly extended from the pusher cavity 141 and an ignition tip 22 which is extended towards the gas emitting nozzle 13.

A pusher cap 30 is slidably fitted to the pusher cavity 141 of the casing 11 in a vertically movable manner. The pusher cap 30, which is attached to a top end of the movable operating part 21 of the piezoelectric unit 20, comprises a cap body 31 exposing above the piezoelectric unit casing 14 and a cap leg 32 extending downwardly from the cap body 31 into the pusher cavity 141.

Figure 4:
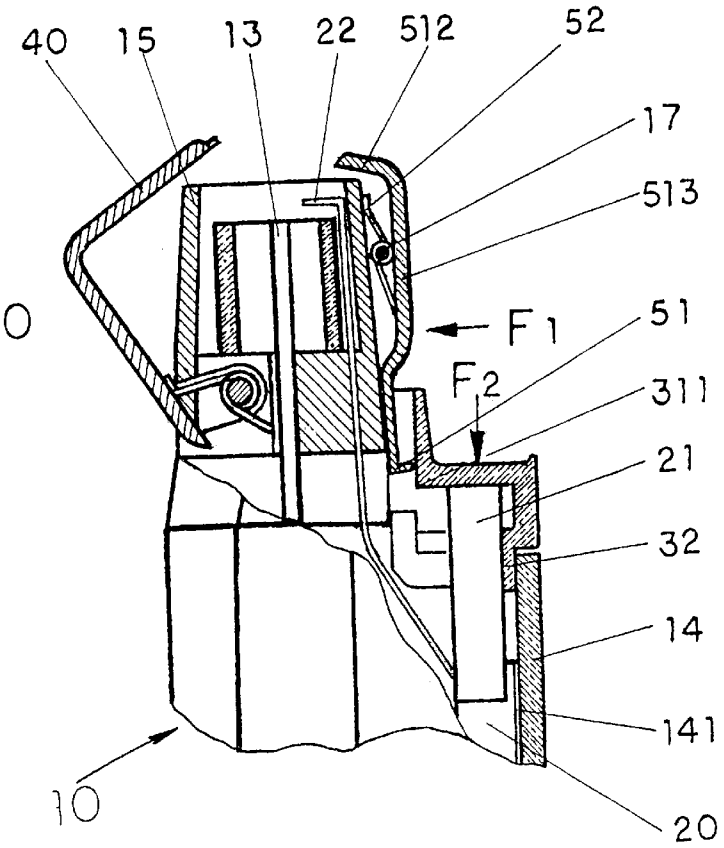
FIG. 4 is a sectional view of the safety lighter according to the above first preferred embodiment of the present invention, illustrating the locking member in unlocked condition for ignition.
Figure 3:
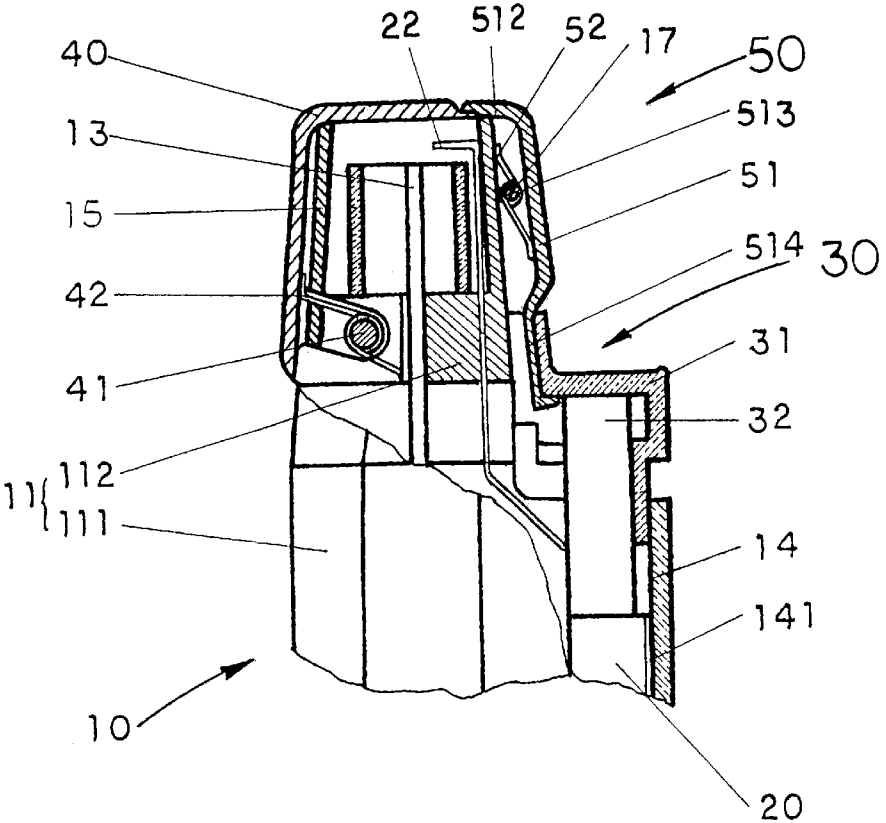
FIG. 3 is a sectional view of the safety lighter according to the above first preferred embodiment of the present invention, illustrating the locking member in locked condition.

Referring to FIGS. 3 and 4, the safety device 50 comprises a locking member 51 and a resilient element 52. The locking member 51, which is pivotally connected to the upper portion 112 of the casing 11, has a stopper latch 511 at a bottom end thereof for normally engaging with the cap body 31, so as to block and stop any possible downward movement of the pusher cap 30. The resilient element 52 is provided between the locking member 51 and the upper portion 112 of the casing 11 for urging the locking member 51 towards the cap body 31 for retaining the engagement of the stopper latch 511 with the cap body 31 for normally blocking any downwardly movement of the pusher cap 30, so as to lock up the pusher cap 30 to prevent the ignition operation of the piezoelectric unit 20.

Figure 1:
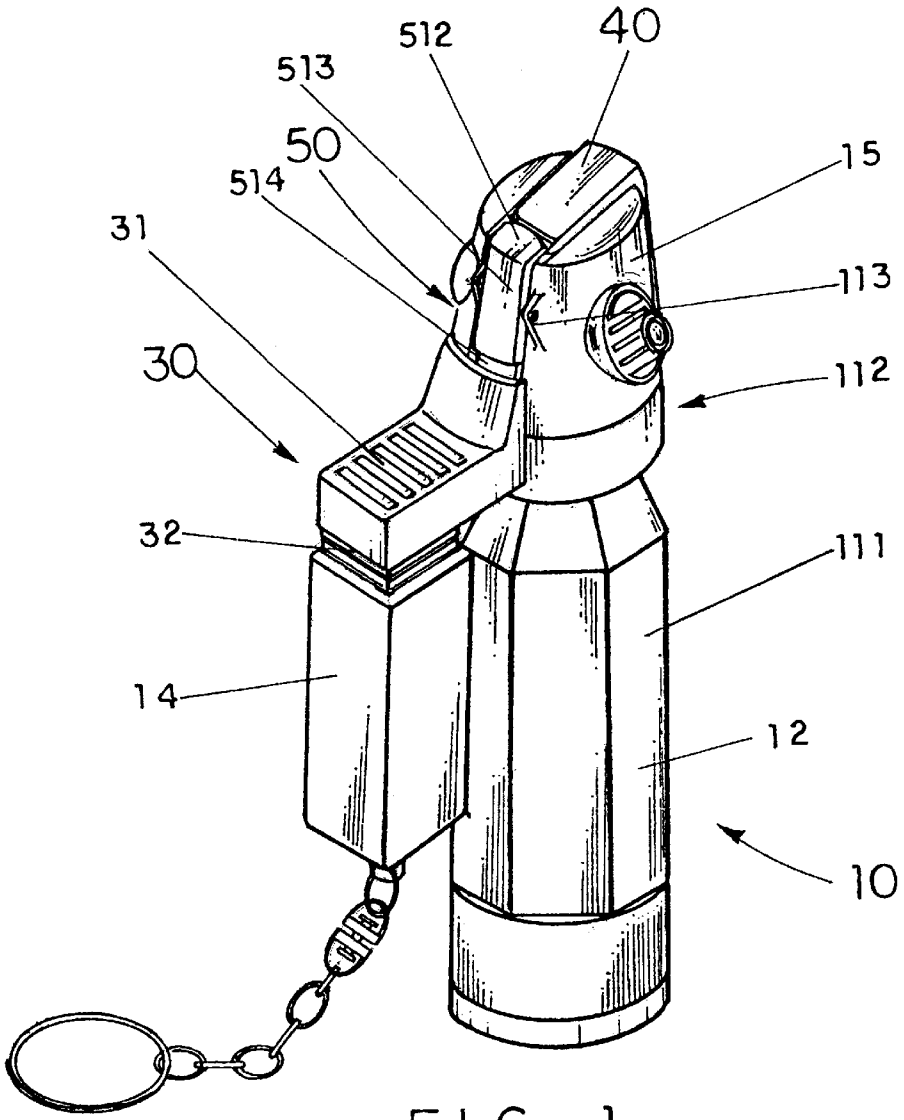
FIG. 1 is a perspective view of a safety lighter according to a first preferred embodiment of the present invention.

According to the first preferred embodiment, as shown in FIGS. 1, 3 and 4, the upper portion 112 of the casing 11 is further pivotally mounted with a L-shaped cover 40 articulated on a pin axis 41 and urged on by a resilient member 42 adapted for elastically maintaining the cover 40 normally in an upright closed position to cover the windshield 15 (as shown in FIG. 3) or in an inclined open position to open the windshield 15 (as shown in FIG. 4).

The pusher cap 30 is operatively connected both to the gas emitting nozzle 13 and to the piezoelectric unit 20 for striking spark through and out the igniting tip 22 toward the gas emitting nozzle 13 which is simultaneously operated to release gas by a gas rod activator. The ejecting gas emitted from the gas emitting nozzle 13 will be ignited by the striking spark ejected from the igniting tip 22 of the piezoelectric unit 20.

Referring to FIGS. 1 and 2, according to the first embodiment, the locking member 51 is in a S-shaped, which further comprises a top lip 512 extended to a top edge of the upper portion 112 of the casing 11 for holding cover 40 in the closed position as shown in FIG. 3, a lever body 513 which has a U-shaped cross section for pivotally hinged between a pair of joints 113 sidewardly provided on the upper portion 112 of the casing 11, and a locking arm 514 downwardly extended from the lever body 513. The stopper latch 511 is integrally and inwardly protruded from a bottom end of the locking arm 514, so as to downwardly extend the stopper latch 511 to engage with the cap body 31 by hooking the stopper latch 511 to an bottom edge 311 of the cap body 31, as shown in FIG. 3, so as to block the pusher cap 30 in a vertical manner. The length of the stopper latch 511 is predetermined that the locking member 51 is arranged to be pushed inwardly enough to move the stopper latch 511 away from the bottom edge 311 of the cap body 31 in purpose of unlocking the lighter, as shown in FIG. 4.

According to the first preferable embodiment of the present invention, the resilient element 52 is a kind of spring mounted on an axle 17 projected from the upper portion 112 so as to mount resilient element 52 between the locking member 51 and the upper portion 112 of the casing 11. The resilient element 52 has two ends biasing against the locking member 51 and the upper portion 112 of the casing 11. Whereby, the resilient element 52 will normally urge and retain the locking member 51 locking up the pusher cap 30 by blocking the downwardly movement of the pusher cap 30 with the stopper latch 511 for preventing any ignition operation of the piezoelectric unit 20.

In other words, the piezoelectric lighter 10 is normally locked from ignition unless an adult user's thumb applies an inward force F1 to push the locking member 51 until the stopper latch 511 disengages with the cap body 31 and, at the same time, a downward force F2 to press down the pusher cap 30 to compress the piezoelectric unit 20 in order to ignite the piezoelectric lighter 10. After each ignition, the resilient element 52 will automatically rebound the locking member 51 outwardly to lock up the pusher cap 30 once the user's inwardly pushing force applied against the locking member 51 is released.

As shown in FIG. 4, when the inward force F1 pushes the locking member 51 inwardly, not only the stopper latch 511 is pressed inwards to release the engagement with the cap body 31, but also the top lip 512 will simultaneously pull outwards to release the holding of the cover 40, so that one single action of pushing the locking member 51 can simultaneously open the cover 40 and unlock the pusher cap 30 for ignition operation.

By releasing the depression of the pusher cap 30, the compressed piezoelectric unit 20 will then rebound to return to its original position that upwardly pushes the pusher cap 30 returning from a lower igniting position to its upper normal position instantly. Due to the rebounding force of the resilient element, the locking member 51 will rebound outwardly back to the lock-up condition by re-hooking the stopper latch 511 on the bottom edge 311 of the cap body 31, as shown in FIG. 3.

Figure 5:
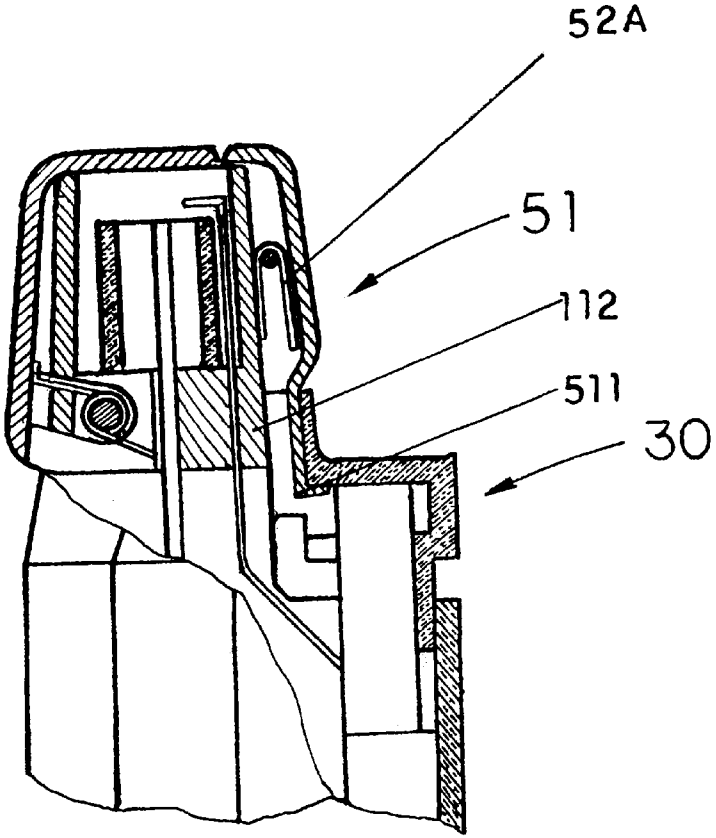
FIG. 5 is a sectional view illustrating an alternative mode of the resilient element of the safety lighter according to the above first preferred embodiment of the present invention.

FIG. 5 illustrates a first alternative resilient element 52A of the first preferable embodiment of the present invention, wherein the resilient element 52A comprises a n-shaped spring clip having two ends urging against the locking member 51 and the upper portion 112 respectively for retaining the locking member 511 locking up the pusher cap 30 so as to block any downwardly movement of the pusher cap 30.

Figure 6:
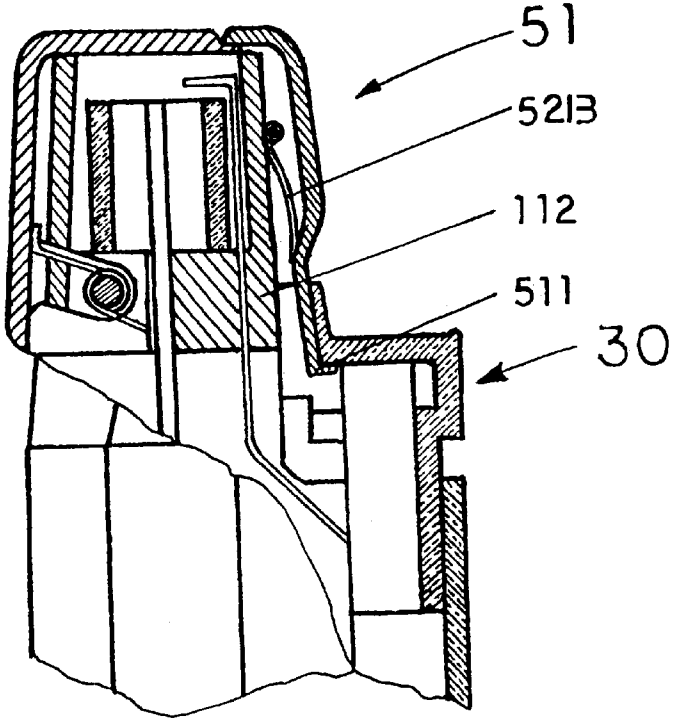
FIG. 6 is a sectional view illustrating another alternative mode of the resilient element of the safety lighter according to the above first preferred embodiment of the present invention.

Moreover, FIG. 6 illustrates a second alternative resilient element 52B of the preferable embodiment of the present invention, wherein the resilient element 52B comprises a piece of elastic lever for urging and retaining the locking member 511 locking up the pusher cap 30 so as to block any downwardly movement of the pusher cap 30.

Figure 7:
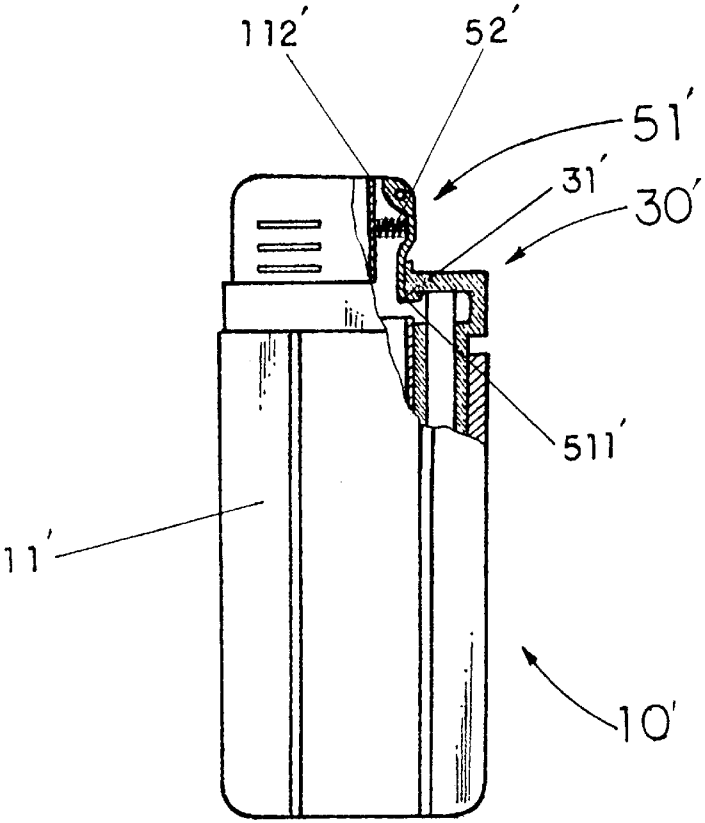
FIG. 7 is a partially sectional view of a safety lighter according to a second preferred embodiment of the present invention.

Referring to FIG. 7, an alternative type of piezoelectric lighter 10' according to a second preferred embodiment of the present invention is illustrated, which has a basically identical structure with the above first preferred embodiment. The main objective of the second embodiment is to illustrate that the concept of locking up the piezoelectric lighter by engaging the pusher cap 30' with a locking member 51' can also be applied to another style of piezoelectric lighter as shown in FIG. 7, wherein since there is no cover 40 employed in such kind of lighter, the top lip 512 in the first embodiment is eliminated. The top end of the shortened locking member 51' is pivotally hinged to the upper portion 112' of the casing 11'. A compression spring is used as the resilient element 52' and positioned between the upper portion 112' and the locking member 51' for retaining the locking member 51' in lock-up position by engaging the stopper latch 511' with the cap body 31' of the pusher cap 30' for blocking any downward movement of the pusher cap 30'.

Figure 8:
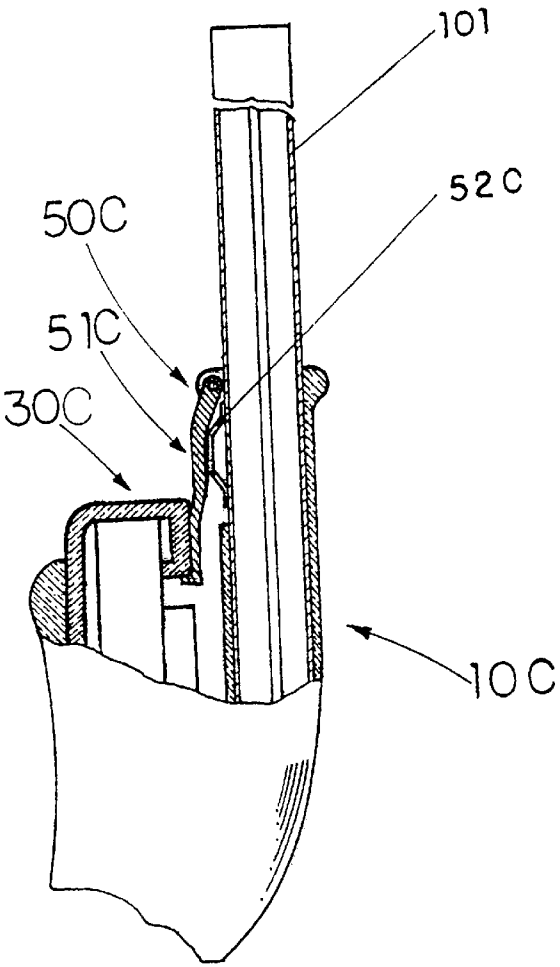
FIG. 8 is a partial section view of a safety lighter according to a third preferred embodiment of the present invention.

As shown in FIG. 8, a third preferred embodiment of the present invention is illustrated, wherein the safety device 50C is employed in a barbecue type piezoelectric lighter 10C. It has a structure similar to the above first and second embodiments, wherein the windshield 15 of the cigarette type piezoelectric lighter 10, 10', as shown in FIGS. 1 to 7, is replaced with an elongated nozzle tube 101 of the barbecue type piezoelectric lighter 10C while the other components and the structure remain the same as the cigarette type piezoelectric lighter. Moreover, the resilient element 52C as shown in FIG. 8 is embodied as a curved elastic strip for urging against the locking member 51C for blocking the downwardly movement of the pusher cap 30C so as to lock up any ignition operation of the lighter. Also, it is worth to mention that all other alternative modes of the resilient element as shown in FIGS. 1 to 7 can also be embodied in such a barbecue type piezoelectric lighter 10C.

In accordance with the preferred embodiments and its alternative modes as disclosed above, the piezoelectric lighter of the present invention can prevent children from using of the lighter by incorporating the safety device without substantial change to the configuration of the lighter. Children are unable to depress the pusher cap since the pusher cap is locked by the stopper latch of the locking member. In fact, even though a child who figures out that the locking member must be forced transversely inward before depressing the pusher cap, it is still nearly impossible for a child to simultaneously push the locking member and depress the pusher cap because a thumb of the child does not have sufficient power to compress the resilient unit and the spring inside the piezoelectric unit at the same time. However, an adult's thumb is strong enough to operate the Piezoelectric lighter in one continuous motion of pushing the locking member and depressing the pusher cap. Moreover, no expensive part or complicate mechanism is added or incorporated and the manufacturing procedure of the present invention is easy so that the cost of the present invention is relatively inexpensive and will increase the competition in the lighter industry.

What is claimed is:

1. A safety lighter, comprising:

a casing having a lower portion containing a pusher cavity and a liquefied gas storage case, and an upper portion having a gas emitting nozzle provided therein to communicate with said liquefied gas storage case for controlling a flow of gas;

a piezoelectric unit fitted in said pusher cavity of said casing for generating piezoelectricity, wherein said piezoelectric unit comprises a movable operating part upwardly extended from said pusher cavity and an ignition tip extended towards said gas emitting nozzle;

a pusher cap slidably fitted to said pusher cavity of said casing in a vertically movable manner, said pusher cap being attached to a top end of said piezoelectric unit and comprising a cap body exposed above said pusher cavity and a cap leg extending downwardly from said cap body into said pusher cavity; and a safety device which comprises:

a locking member, which is pivotally connected to said upper portion of said casing, having a stopper latch at a bottom end thereof for normally engaging with said cap body so as to block and stop any possible downward movement of said pusher cap; and a resilient element provided between said locking member and said upper portion of said casing for urging said locking member towards said cap body for retaining said engagement of said stopper latch with said cap body for normally blocking any downwardly movement of said pusher cap, so as to lock up said pusher cap to prevent any ignition operation of said piezoelectric unit;

wherein said upper portion of said casing is further pivotally mounted with an L-shaped cover articulated on a pin axis and biased by a resilient member adapted for elastically maintaining said cover selectively in an upright closed position to normally cover a windshield mounted on said upper portion of said casing or in an inclined open position to open said windshield;

thereby said piezoelectric lighter is locked from ignition normally unless a pushing force is applied to push said locking member inwardly until said stopper latch disengages with said cap body, so that said pusher cap is capable of being pressed down to ignite said piezoelectric lighter, wherein after every ignition, said resilient element automatically rebounds said locking member outwardly to lock up said pusher cap once said pushing force applied against said locking member is released.

2. A safety lighter, as recited in claim 1, wherein said locking member is in an S-shape that further comprises a top lip extended to a top edge of said upper portion of said casing for holding said cover in said closed position.

3. A safety lighter, as recited in claim 2, wherein said locking member further comprises a lever body, which is extended downwardly from said top lip, having a U-shaped cross section for pivotally hinging between a pair of joints sidewardly provided on said upper portion of said casing, and a locking arm downwardly extended from said lever body, wherein said stopper latch is integrally and inwardly protruded from a bottom end of said locking arm, so as to downwardly extend said stopper latch to engage with said cap body by hooking said stopper latch to a bottom edge of said cap body, so as to block said pusher cap in a vertical manner.

4. A safety lighter, as recited in claim 3, wherein said piezoelectric lighter is a cigarette lighter which further comprises a windshield mounted on said upper portion of said casing and encircling said gas emitting nozzle.

5. A safety lighter, as recited in claim 3, wherein said resilient element comprises a spring mounted on an axle projected from said upper portion so as to mount said spring between said locking member and said upper portion of said casing, wherein said spring has two ends biasing against said locking member and said upper portion of said casing.

6. A safety lighter, as recited in claim 3, wherein said resilient element comprises a n-shaped spring clip having two ends urging against said locking member and said upper portion respectively so as to retain said locking member to lock up said pusher cap in order to block any downward movement of said pusher cap.

7. A safety lighter, as recited in claim 3, wherein said resilient element comprises a piece of elastic lever to urge and retain said locking member to lock up said pusher cap so as to block any downward movement of said pusher cap.

* * * * *